US006170454B1

(12) United States Patent
McFarland et al.

(10) Patent No.: US 6,170,454 B1
(45) Date of Patent: Jan. 9, 2001

(54) PISTON APPARATUS AND METHODS

(75) Inventors: James D. McFarland, Austin, TX (US); Jack Dean Falkenrath, Salt Lake City, UT (US)

(73) Assignee: Techniphase Industries, Inc., Salt Lake City, UT (US)

( * ) Notice: Under 35 U.S.C. 154(b), the term of this patent shall be extended for 0 days.

(21) Appl. No.: 09/127,173

(22) Filed: Jul. 31, 1998

(51) Int. Cl.[7] ..... F02F 3/24
(52) U.S. Cl. ..... 123/193.6
(58) Field of Search ..... 123/193.6, 661; 92/213

(56) References Cited

U.S. PATENT DOCUMENTS

| | | | | |
|---|---|---|---|---|
| D. 377,493 | | 1/1997 | Oda et al. | D15/5 |
| 1,674,733 | | 6/1928 | Maher . | |
| 3,601,008 | | 8/1971 | Alexander | 92/141 |
| 3,766,900 | | 10/1973 | Aiti | 123/193 |
| 4,046,116 | | 9/1977 | Burnham | 123/48 R |
| 4,050,420 | | 9/1977 | Cataldo | 123/30 C |
| 4,114,518 | | 9/1978 | Glover, Jr. et al. | 92/208 |
| 4,166,436 | | 9/1979 | Yamakawa | 123/30 C |
| 4,235,203 | | 11/1980 | Thery | 123/275 |
| 4,289,099 | | 9/1981 | Nakanishi et al. | 123/307 |
| 4,291,662 | * | 9/1981 | Nakamura et al. | 123/661 |
| 4,296,720 | * | 10/1981 | Nakanishi et al. | 123/661 |
| 4,300,499 | | 11/1981 | Nakanishi et al. | 123/307 |
| 4,318,376 | * | 3/1982 | Nakamura et al. | 123/661 |
| 4,324,214 | | 4/1982 | Garcea | 123/309 |
| 4,467,752 | | 8/1984 | Yunick | 123/193 P |
| 4,541,377 | | 9/1985 | Amos | 123/307 |
| 4,557,231 | | 12/1985 | Thery | 123/279 |
| 4,565,181 | | 1/1986 | August | 123/661 |
| 4,567,863 | | 2/1986 | Fletcher | 123/193 P |
| 4,587,932 | | 5/1986 | Moebus | 123/41.35 |
| 4,617,888 | | 10/1986 | Dent | 123/307 |
| 4,694,735 | | 9/1987 | Tatematsu et al. | 92/208 |
| 4,893,596 | | 1/1990 | Nonaka | 123/193 P |
| 4,987,865 | | 1/1991 | Schenkel | 123/193 P |
| 5,007,394 | | 4/1991 | Brychta et al. | 123/279 |
| 5,113,817 | | 5/1992 | Kemnitz et al. | 123/193.6 |
| 5,224,449 | | 7/1993 | Fukano et al. | 123/267 |
| 5,317,958 | | 6/1994 | Leites et al. | 92/186 |
| 5,511,521 | | 4/1996 | Bischofberger et al. | 123/193.6 |
| 5,601,010 | | 2/1997 | Sawada et al. | 92/222 |
| 5,660,156 | | 8/1997 | Whitacre et al. | 123/279 |
| 5,727,535 | | 3/1998 | Wallace | 123/664 |

* cited by examiner

*Primary Examiner*—Marguerite McMahon
(74) *Attorney, Agent, or Firm*—Kirton & McConkie; Berne S. Broadbent; Dale E. Hulse

(57) ABSTRACT

A piston for use with an internal combustion engine is disclosed in one embodiment of the present invention as including a crown having an exhaust valve area, an intake valve area, and means for moving exhaust toward the exhaust valve area. The exhaust moving means includes means for homogenizing the air/fuel mixture. The homogenizing means may also include means for creating eddies within the air/fuel mixture. In addition, the piston may include means for concentrating the air/fuel mixture toward the area of ignition. In one presently preferred embodiment, the structure used to accomplish the invention includes a raised portion formed on the crown of the piston. The raised portion increases in height from the center of the crown toward the perimeter of the crown. Moreover, the raised portion also has an arcuate shape declining in height along the arcuate shape. The presently preferred raised portion includes a plurality of dimples formed therein for creating eddies within the air/fuel mixture.

21 Claims, 2 Drawing Sheets

PISTON APPARATUS AND METHODS

BACKGROUND

1. The Field of the Invention

This invention relates to internal combustion engines and, more particularly, to novel systems and methods of a piston to be used in an internal combustion engine.

2. The Background Art

For many years internal combustion engines have been used to benefit society. The internal combustion engine, first developed many years ago, has undergone many improvements over the years. Typical internal combustion engines have a cylinder block. A cylinder bore is formed within the cylinder block. The engine includes a cylinder head mounted on the cylinder block. A piston reciprocates within the cylinder bore. The chamber defined by the cylinder head, the top part of the piston, and the cylinder wall is referred to as the combustion chamber.

The cylinder head houses the intake valve and the exhaust valve. An air/fuel mixture is fed into the combustion chamber through the intake valve. A typical engine cylinder head includes a spark plug mounted on the cylinder head so that a spark created by the spark plug is located within the combustion chamber. So placed, the spark ignites the air/fuel mixture and results in combustion. The exhaust created by the combustion is forced out of the combustion chamber through the exhaust valve.

Operation of typical internal combustion engines can be divided into four strokes: the intake stroke, the compression stroke, the power or combustion stroke, and the exhaust stroke. During the intake stroke, the piston moves downwardly in the cylinder bore and an air/fuel mixture is fed into the cylinder bore through the intake valve. Next, during the compression stroke, the piston moves upwardly in the cylinder bore, compressing the air/fuel mixture within the combustion chamber. Then, the air/fuel mixture is ignited, typically by a spark from a spark plug. After ignition is the power or combustion stroke where the piston is forced downward in the bore from the forces of the combustion. Finally, there is the exhaust stroke, where the piston moves upwardly in the cylinder bore forcing exhaust out of the exhaust valve, which has been opened for this purpose.

The air/fuel mixture quality is a key to an efficient power stroke. Often the air/fuel mixture tends to separate. As a result, the fuel droplets within the combustion chamber get larger and larger. The larger the fuel droplets are, the more separated the air and fuel are resulting in a less efficient power stroke. The ability to efficiently homogenize and maintain the blend prior to and during the burn is a classical combustion engine problem.

Poor homogeneity of the air/fuel mixture can result in an unequal amount of fuel in each cylinder of the engine. An unequal amount of fuel resulting from poor mixture homogeneity creates an eventual combustion pressure imbalance, cylinder-to-cylinder.

Typical piston heads are flat on top or dish shaped with a flat bottom to the dish. During the compression stroke the piston moves upwardly in the cylinder compressing the air/fuel mixture. As the piston approaches the top of the cylinder, the air/fuel mixture is compressed and spread substantially equally in the combustion chamber. Accordingly, the ignition point, usually the tip of a spark plug, is near only a certain portion of the compressed air/fuel mixture. Because only a certain amount is proximate the ignition point, the burn that results is less efficient than it could be.

After the combustion of the air/fuel mixture, the combustion chamber contains exhaust. During a typical exhaust stroke, much of the exhaust is forced out of the exhaust valve. However, a portion of the exhaust remains within the combustion chamber. This leftover exhaust results in less volume being available for new air/fuel mixture being drawn into the chamber during the following intake stroke. With less air/fuel mixture drawn in, less power can be created.

BRIEF SUMMARY AND OBJECTS OF THE INVENTION

In view of the foregoing, it is a primary object of the present invention to provide a piston for use with an internal combustion engine capable of increasing the efficiency of the engine.

Another object of the present invention is to improve combustion efficiency.

It is also an object to improve the air/fuel mixture quality.

Another object of the present invention is to homogenize the air/fuel mixture.

An additional object is to more effectively force exhaust out of the exhaust valve.

A further object of the present invention is to maximize the burn by concentrating the air/fuel mixture toward the ignition area of the internal combustion engine.

A still further object of the present invention is to balance the combustion pressure between cylinders.

Another object is to create more power within the engine.

Consistent with the foregoing objects, and in accordance with the invention as embodied and broadly described herein, a piston for use with an internal combustion engine is disclosed in one embodiment of the present invention as including a crown having an exhaust valve area, an intake valve area, and means for moving exhaust toward the exhaust valve area. The exhaust moving means includes means for homogenizing the air/fuel mixture. The homogenizing means may also include means for creating eddies with the air/fuel mixture. In addition, the piston may include means for concentrating the air/fuel mixture toward the area of ignition. In one presently preferred embodiment, the structure used to accomplish the invention may include a raised portion formed on the crown of the piston. The raised portion increases in height from the center of the crown toward the perimeter of the crown. The raised portion also has an arcuate shape declining in height along the arcuate shape. The raised portion includes a plurality of dimples formed therein for creating eddies within the air/fuel mixture.

BRIEF DESCRIPTION OF THE DRAWINGS

The foregoing and other objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described with additional specificity and detail through use of the accompanying drawings in which:

DETAILED DESCRIPTION OF THE PREFERRED EMBODIMENTS

Figure 1:
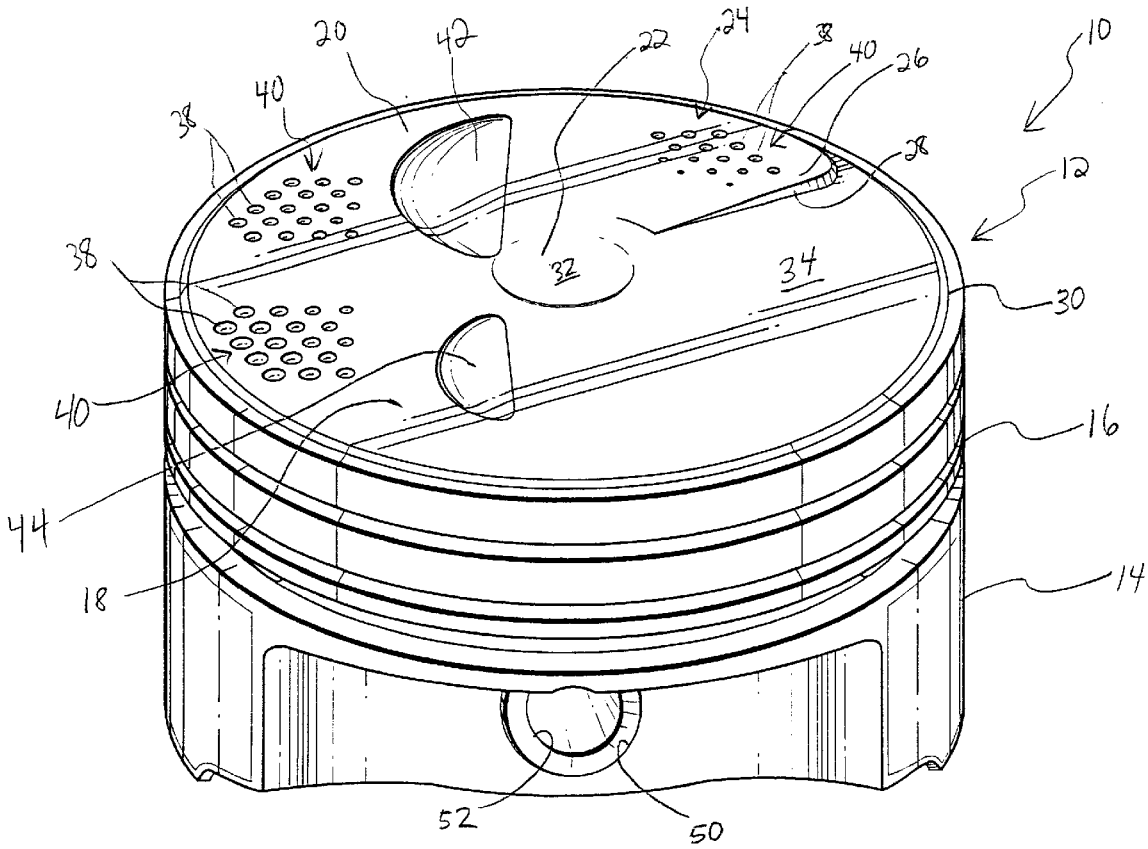
FIG. 1 is a perspective view of a piston made in accordance with one presently preferred embodiment of the present invention.
Figure 2:
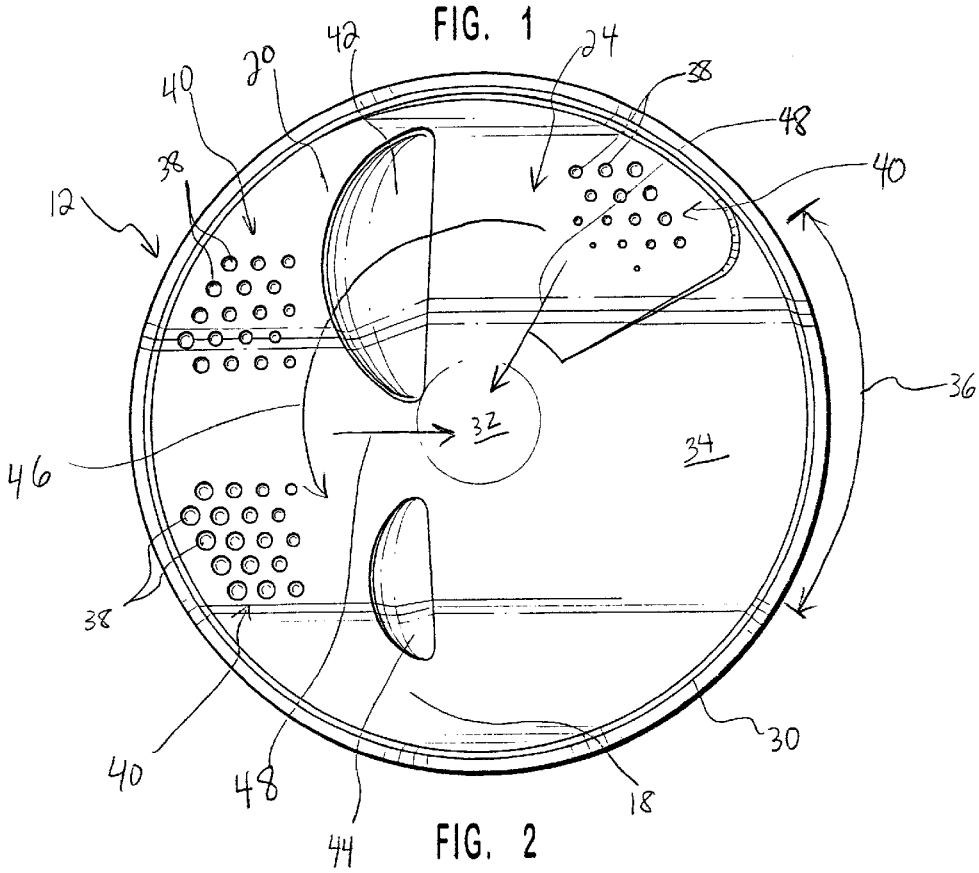
FIG. 2 is a top plan view of the piston of FIG. 1.
Figure 3:
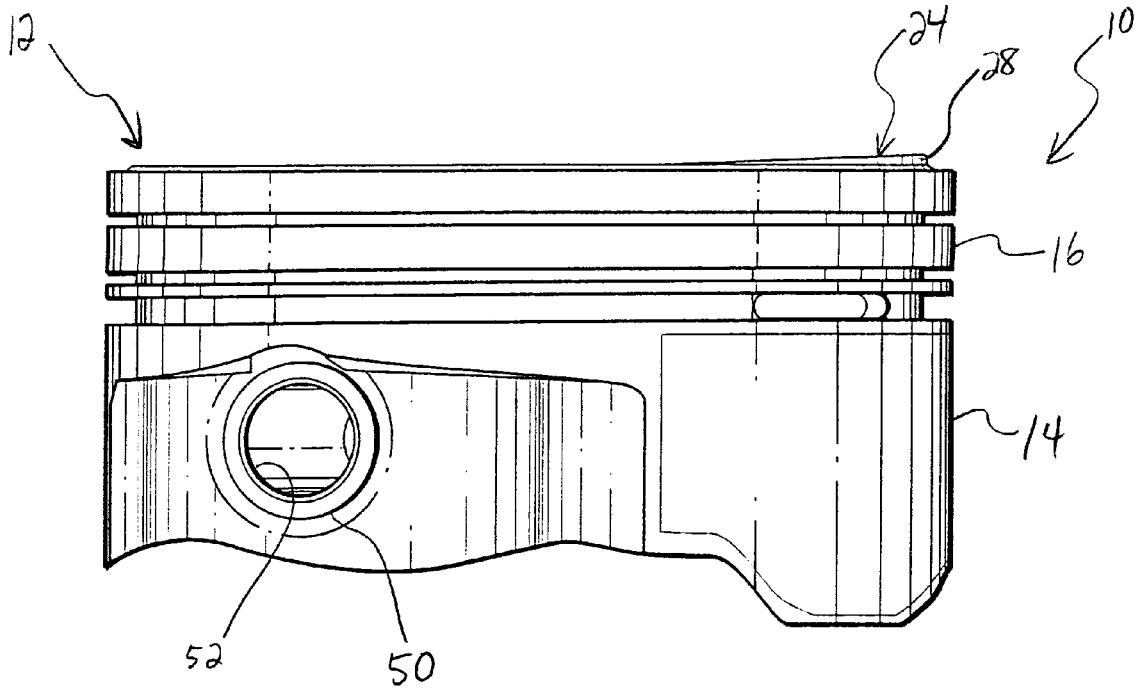
FIG. 3 is a side elevational view of the piston of FIG. 1.

It will be readily understood that the components of the present invention, as generally described and illustrated in the Figures herein, could be arranged and designed in a wide variety of different configurations. Thus, the following more detailed description of the embodiments of the system and method of the present invention, as represented in FIGS. 1 through 3, is not intended to limit the scope of the invention, as claimed, but it is merely representative of the presently preferred embodiments of the invention.

The presently preferred embodiments of the invention will be best understood by reference to the drawings, wherein like parts are designated by like numerals throughout.

Embodiments of the present invention are designed for use with an internal combustion engine (not shown). Typical internal combustion engines have a cylinder block (not shown). A cylinder bore (not shown) is formed within the cylinder block. The engine includes a cylinder head (not shown) mounted on the cylinder block. A piston reciprocates within the cylinder bore. The combustion chamber (not shown) is defined by the cylinder head, the top part of the piston, and the cylinder wall.

The cylinder head houses the intake valve (not shown) and the exhaust valve (not shown). The intake valve is movably mounted on the cylinder head. Similarly, the exhaust valve is movably mounted on the cylinder head. An air/fuel mixture is fed into the combustion chamber through the intake valve. A typical engine cylinder head includes a spark plug (not shown) mounted on the cylinder head such that the spark plug's sparking points are located within the combustion chamber. So structured, the spark plug causes a spark which ignites the air/fuel mixture and results in combustion. The exhaust created by the combustion is forced out of the combustion chamber through the exhaust valve.

Operation of typical internal combustion engines can be divided into four strokes: the intake stroke, the compression stroke, the expansion or combustion stroke, and the exhaust stroke. During the intake stroke, the piston moves downwardly in the cylinder bore and the air/fuel mixture is fed into the cylinder bore through the intake valve. Next, during the compression stroke, the piston moves upwardly in the cylinder bore, compressing the air/fuel mixture within the combustion chamber. Then, the air/fuel mixture is ignited, typically by a spark from a spark plug. After ignition is the power or combustion stroke where the piston is forced downward in the bore from the forces of the combustion. Finally there is the exhaust stroke, where the piston moves upwardly in the cylinder bore forcing exhaust out of the exhaust valve, which has been opened for this purpose.

As shown in FIG. 1, a piston 10 made in accordance with the present invention includes a crown 12, a skirt 14, and a ring-bearing portion 16. Those skilled in the art will appreciate the functions of the piston skirt 14 and ring-bearing portion 16. The skirt 14 and ring-bearing portion 16 are designed and implemented similarly to the skirts and ring-bearing portions on conventional pistons. The skirt 14 includes a wrist pin bore 50 and a wrist pin 52.

The top side of the piston is the crown 12. The crown 12, the cylinder wall (not shown), and the cylinder head (not shown) form the combustion chamber (not shown). The crown 12 includes an exhaust valve area 18 positioned below the exhaust valve (not shown). Similarly, the crown 12 includes an intake valve area 20 positioned below the intake valve. The crown 12 includes means for moving exhaust toward the exhaust valve area 18. The exhaust moving means functions to move the exhaust toward the exhaust valve area 18, and accordingly toward the exhaust valve (not shown), during the exhaust stroke.

The exhaust moving means includes means for homogenizing an air/fuel mixture. The homogenizing means functions to maintain the air/fuel mixture in a homogenous state, and it functions mainly during the compression stroke, and also in the intake stroke.

In one presently preferred embodiment, the homogenizing means includes means for creating eddies within the air/fuel mixture. By creating eddy currents within the air/fuel mixture the homogeneity of the mixture is substantially maintained and/or encouraged.

The crown 12 may also include means for concentrating the air/fuel mixture toward an area of ignition 22. The area of ignition 22 is the area proximate the ignition point. In typical internal combustion engines the ignition point is where the spark is created by the spark plug (not shown). Thus, in typical engines, the area of ignition 22 would be the area proximate the spark plug. The concentrating means functions mainly during the compression stroke to concentrate or focus the air/fuel mixture toward the area of ignition 22.

The present invention may be accomplished through a variety of structures and/or means. FIGS. 1 through 3 illustrate one presently preferred embodiment of the present invention. It will therefore be appreciated that the structures as shown and described in relation to these figures could be varied and implemented through different structures and still be within the scope of the present invention.

In the presently preferred embodiment, the exhaust moving means comprises a raised portion 24. The raised portion 24 also includes the homogenizing means and the concentrating means. As shown in FIG. 1, the raised portion 24 has an arcuate shape declining in height along the arcuate shape. The raised portion 24 begins at a high part 26 being defined by a ridge 28. In current design, the highest point of the raised portion 24 is at the high part 26 near the crown's 12 perimeter 30. The raised portion 24 then decreases in height along its arcuate path.

The raised portion 24 increases in height from the center 32 of the crown 12 toward the perimeter 30 of the crown 12. This aspect of the raised portion 24 embodies the presently preferred concentrating means. As described, the raised portion 24 has two slopes, the first slope is arcuate in nature and is the slope of the arcuate path of the raised portion 24. A path 46 indicating the general shape and direction of this slope is shown in FIG. 2. The second slope of the raised portion 24 is the slope defined by a direct path on the raised portion 24 from the center 32 of the crown 12 toward the perimeter 30. This downward slope 48 is illustrated in FIG. 2. The two slopes tend to function together to move exhaust toward the exhaust valve, to cause motion in the air/fuel mixture to homogenize the mixture, and also to concentrate the air/fuel mixture toward the area of ignition 22.

In the presently preferred embodiment, the raised portion 24 has a peak of approximately 1.8 millimeters in height (approximately 0.07 inches).

The raised portion 24 spans an angle. This angle may vary according to varying design constraints that may be placed on a particular piston. The crown 12 includes two portions, the raised portion 24 and a substantially flat portion 34. In the presently preferred embodiment, the substantially flat portion 34 is substantially level with the center 32 of the crown 12. As shown in FIG. 2, the angle of the raised portion 24 added to the angle of the flat portion 34 makes up the 360 degrees of the crown 12. In the presently preferred embodiment, the angle 36 of the flat portion 34 is approximately 45 degrees, and the angle of the raised portion 24 is approximately 315 degrees. Thus, the arcuate path of the raised portion 24 spans 315 degrees.

It will be appreciated, however, that the angles of the raised and flat portions 24, 34 may vary according to varying design objectives. For example, the raised portion 24 angle may be from approximately 90 degrees to 270 degrees or more. Raised portion 24 angles less than 90 degrees may not function as efficiently as bigger angles. Many factors may influence the angles of the raised portion 24 and the flat portion 34. For example, the position of the spark plug of a particular engine could require the angles of the portions 24, 34 to vary accordingly.

In one presently preferred embodiment, the means for creating eddies within the air fuel mixture includes a plurality of dimples 38 formed in the raised portion 24. In current design, the dimples 38 have a depth of approximately 0.64 millimeters (approximately 0.025 inches), and a diameter of approximately 1.9 millimeters (approximately 0.075 inches). The dimples 38 may be placed on the raised portion 24 in dimple groupings 40. By varying the placement of the dimple groups 40, and the number of dimples 38 within each group 40, varying degrees of homogeneity of the air/fuel mixture may be achieved. In current design, the crown 24 has three dimple groups 40, and within each dimple group 40 there are approximately eighteen equally sized dimples 38.

As shown in FIGS. 1 and 2, the crown 12 may include an intake valve recess 42 in the intake valve area 20. The intake valve recess 42 allows the piston 10 to come up higher in the cylinder because it provides a recess 42 in which the intake valve (not shown) may fit without touching the crown 12. Similarly, the crown 12 may include an exhaust valve recess 44 for the exhaust valve (not shown).

The crown 12 may be made of a variety of substances. In its preferred embodiments, the crown 12 is made of various aluminum alloys. In one presently preferred embodiment, the crown 12 is made of hypereutectic alloy.

FIG. 3 illustrates a side elevational view of the piston 10. As shown, the raised portion 24 has a peak proximate the perimeter 30 of the crown 12, and decreases in height toward the center 32 of the crown 12.

A method used for increasing the efficiency of an internal combustion engine includes the step of homogenizing the air/fuel mixture within the cylinder bore. The method also includes the step of concentrating the air/fuel mixture toward a point of ignition 22. The method includes the step of moving exhaust toward the exhaust valve.

The step of homogenizing includes, in one presently preferred embodiment, moving the air/fuel mixture in a substantially arcuate motion 46. In current design the step of homogenizing also includes creating eddies within the air/fuel mixture.

As shown and described, embodiments of a piston 10 made in accordance with the present invention benefit the operation of an internal combustion engine in several ways. Features and aspects of the present invention benefit operation of an engine during the intake stroke. The piston apparatus 10 benefits the operation of the engine during the intake stroke mainly because of the effective exhaust stroke. Because the previous exhaust stroke more efficiently forced the exhaust out of the cylinder, the cylinder now has more volume available for the incoming air/fuel mixture. With more air/fuel mixture, more power can be created. The homogenizing of the air/fuel mixture may occur during the intake stroke similar to the benefits received in the compression stroke. However, the benefit of homogenization is usually greater during the compression stroke.

The present invention also benefits the operation of an engine during the compression stroke. As the piston 10 ascends to Top Dead Center (TDC) the raised portion 24 has an influence on the mixtures trapped in the combustion space. The raised portion 24 tends to direct mixture motion in a circular direction from the intake valve to the exhaust valve in a swirl pattern along the arcuate shape. As shown in FIG. 2, the raised portion 24 tends to direct the mixture along a swirl path 46 toward the exhaust valve area 18. During the compression stroke, this motion is useful and advantageous because it homogenizes the air/fuel mixture. The benefit from the raised portion 24, in this stroke, is mainly the swirl motion created. Motion helps the air/fuel mixture stay atomized and homogenous.

The dimples 38 serve to further enhance the homogenizing of the air/fuel mixture. The raised portion 24 moves the air/fuel mixture over the dimples 38, which further enhance the homogenizing. Along the swirl path 46, the dimples 38 on the raised portion 24 act to homogenize the mixture and maintain homogeneity by creating small eddy currents.

The aspect of the raised portion 24 declining in height from the perimeter 30 of the crown 12 to the center 32 of the crown 12 adds benefits to the compression stroke. This lower center 32 aids in the compression stroke by concentrating the air/fuel mixture toward the ignition area 22. The decline in height from the perimeter 30 to the center 32 creates a downward slope 48. As shown in FIG. 2, the raised portion 24 slopes downwardly along its arcuate shape and as a result tends to force the air/fuel mixture along the arcuate path 46 corresponding to the general shape of the arcuately shaped raised portion 24. In addition, the raised portion 24 has a downward slope 48 from the perimeter 30 toward the center 32.

The ignition area 22 typically corresponds to the spark plug tip. By concentrating the air/fuel mixture toward the ignition area 22, the spark will initiate a better burn. The extra efficiency in combustion allows the use of less timing advance for maximum torque. This reduction in ignition timing advance adds to the engine's durability and fuel economy as the piston can now spend less time fighting the increasing cylinder pressure as it makes its way to TDC.

The power stroke (or combustion stroke) is also benefited by the present invention. The more rapid and more complete burn made possible by the present invention during the compression stroke results in extra torque during the power stroke. In addition, because the ignition timing advance has been reduced, more of the cylinder pressure caused by the ignited air/fuel mix can be turned into useful energy.

The present invention also benefits the operation of an engine during the exhaust stroke. The raised portion 24 tends to direct mixture motion in a circular direction from the intake valve to the exhaust valve in a swirl pattern 46. This motion more effectively gets the exhaust ejected from the combustion chamber. When the piston 10 nears the top of its travel it comes within close proximity to the cylinder head. This near collision creates a quench effect and forces the last remaining exhaust toward the exhaust valve. The ridge 28 at the beginning of the raised portion 24 substantially stops the exhaust from continuing in a circular motion. The ridge 24 tends to hold the exhaust near the exhaust valve until it can be expelled.

From the above discussion, it will be appreciated that the present invention provides a piston for use with an internal combustion engine that increases the efficiency of the engine. The present invention accomplishes this through several ways. Embodiments of the present invention improve combustion efficiency by creating and maintaining a more homogeneous air/fuel mixture. The increased homogeneity of the air/fuel mixture within each cylinder tends to balance the combustion pressure between cylinders.

In addition, the present invention more effectively forces exhaust out of the exhaust valve. Moreover, it maximizes the burn by concentrating the air/fuel mixture toward the ignition area of the internal combustion engine.

Through these and other improvements achieved through use of the present invention, an internal combustion engine using pistons made in accordance with the present invention is capable of creating more power.

The present invention may be embodied in other specific forms without departing from its spirit or essential characteristics. The described embodiments are to be considered in all respects only as illustrative, and not restrictive. The scope of the invention is, therefore, indicated by the appended claims, rather than by the foregoing description. All changes which come within the meaning and range of equivalency of the claims are to be embraced within their scope.

What is claimed and desired to be secured by United States Letters Patent is:

1. A piston for use with an internal combustion engine, the engine having a cylinder bore therein and an exhaust valve associated with the cylinder bore, said piston being reciprocally movable in the cylinder bore, said piston comprising:

a crown, said crown including:

an exhaust valve area positioned below the exhaust valve; and a raised portion, said raised portion increasing in height from a center of said crown toward a perimeter of said crown, and said raised portion having an arcuate-shaped declining in height along said arcuate shape, and wherein said raised portion includes a plurality of dimples formed therein.

2. A piston for use with an internal combustion engine, the engine having a cylinder bore therein, said piston being reciprocally movable in the cylinder bore, said piston comprising:

a crown, said crown including:

a plurality of dimples formed in said crown to generate eddies within the air/fuel mixture.

3. A piston as defined in claim 2 further comprising means for concentrating the air/fuel mixture toward a point of ignition.

4. A piston as defined in claim 2 wherein each of said dimples has a depth of approximately 0.64 millimeters.

5. A piston as defined in claim 2 wherein each of said dimples has a diameter of approximately 1.9 millimeters.

6. A piston as defined in claim 2 wherein said crown is made of hypereutectic alloy.

7. A piston for use with an internal combustion engine, the engine having a cylinder bore therein, said piston being reciprocally movable in the cylinder bore, said piston comprising:

a crown, said crown including; a plurality of dimple groups, each dimple group comprising a plurality of dimples formed in said crown.

8. A piston for use with an internal combustion engine, the engine having a cylinder bore therein, said piston being reciprocally movable in the cylinder bore, said piston comprising:

a crown, said crown including a plurality of dimples formed therein.

9. A piston as defined in claim 8 wherein each of said dimples has a depth of approximately 0.64 millimeters.

10. A piston as defined in claim 8 wherein each of said dimples has a diameter of approximately 1.9 millimeters.

11. A piston as defined in claim 8 wherein said crown is made of hypereutectic alloy.

12. A piston for use with an internal combustion engine, the engine including a cylinder block having a cylinder bore therein, a cylinder head mounted on said cylinder block, an intake valve movably mounted on the cylinder head, and an exhaust valve movably mounted on the cylinder head, said piston being reciprocally movable in the cylinder bore, said piston comprising:

a skirt;

a ring bearing portion; and a crown having a center and a perimeter, said crown including:

an intake valve area positioned below the intake valve;

an exhaust valve area positioned below the exhaust valve;

a raised portion, said raised portion increasing in height from the center toward the perimeter of said crown, said raised portion beginning at a high part, said high part being on a first side of said intake valve area, said raised portion being an arcuate path declining in height from said high part toward a second side of said intake valve area, said raised portion further comprising a plurality of dimple groups, each dimple group comprising a plurality of dimples formed in said raised portion; and a substantially flat portion comprising the portion of the crown not part of said raised portion.

13. A piston as defined in claim 12 wherein said high part is approximately 1.8 millimeters in height.

14. A piston as defined in claim 13 wherein said raised portion spans an angle of at least 270 degrees.

15. A piston as defined in claim 14 wherein each of said dimples has a depth of approximately 0.64 millimeters.

16. A piston as defined in claim 14 wherein each of said dimples has a diameter of approximately 1.9 millimeters.

17. A piston as defined in claim 12 wherein said crown is made of hypereutectic alloy.

18. A piston as defined in claim 12 wherein said crown further comprises an intake valve recess formed in said intake valve area.

19. A piston as defined in claim 12 wherein said crown further comprises an exhaust valve recess formed in said exhaust valve area.

20. A piston for use with an internal combustion engine, the engine including a cylinder block having a cylinder bore therein, a cylinder head mounted on said cylinder block, an intake valve movably mounted on the cylinder head, and an exhaust valve movably mounted on the cylinder head, said piston being reciprocally movable in the cylinder bore, said piston comprising:

a skirt;

a ring bearing portion; and a crown having a center and a perimeter, said crown including:

an intake valve area positioned below the intake valve, wherein an intake valve recess is formed in said intake valve area;

an exhaust valve area positioned below the exhaust valve;

a raised portion, said raised portion increasing in height from the center toward the perimeter of said crown, said raised portion beginning at a high part, said high part being on a first side of said intake valve area, said raised portion being an arcuate path declining in height from said high part toward a second side of said intake valve area; and a substantially flat portion comprising the portion of the crown not part of said raised portion.

21. A piston for use with an internal combustion engine, the engine including a cylinder block having a cylinder bore therein, a cylinder head mounted on said cylinder block, an intake valve movably mounted on the cylinder head, and an exhaust valve movably mounted on the cylinder head, said piston being reciprocally movable in the cylinder bore, said piston comprising:

a skirt;

a ring bearing portion; and a crown having a center and a perimeter, said crown including:

an intake valve area positioned below the intake valve;

an exhaust valve area positioned below the exhaust valve, wherein an exhaust valve recess is formed in said exhaust valve area;

a raised portion, said raised portion increasing in height from the center toward the perimeter of said crown, said raised portion beginning at a high part, said high part being on a first side of said intake valve area, said raised portion being an arcuate path declining in height from said high part toward a second side of said intake valve area; and a substantially flat portion comprising the portion of the crown not part of said raised portion.

* * * * *